US008469387B2

(12) United States Patent
Grude

(10) Patent No.: US 8,469,387 B2
(45) Date of Patent: Jun. 25, 2013

(54) SKI BINDING DEVICE

(76) Inventor: Per Ståle Grude, Kleppe (NO)

( * ) Notice: Subject to any disclaimer, the term of this patent is extended or adjusted under 35 U.S.C. 154(b) by 1022 days.

(21) Appl. No.: 10/592,302

(22) PCT Filed: Mar. 4, 2005

(86) PCT No.: PCT/NO2005/000079

§ 371 (c)(1),
(2), (4) Date: Oct. 2, 2006

(87) PCT Pub. No.: WO2005/084764

PCT Pub. Date: Sep. 15, 2005

(65) Prior Publication Data

US 2007/0205584 A1 Sep. 6, 2007

(30) Foreign Application Priority Data

Mar. 9, 2004 (NO) ..... 20041023

(51) Int. Cl.
*B63C 9/00* (2006.01)

(52) U.S. Cl.
USPC ..... 280/615; 280/636

(58) Field of Classification Search
USPC ..... 280/611, 614, 615, 623, 636
See application file for complete search history.

(56) References Cited

U.S. PATENT DOCUMENTS

| | | | | |
|---|---|---|---|---|
| 4,154,008 | A | 5/1979 | Jacobs | |
| 4,319,767 | A * | 3/1982 | Emilson | 280/614 |
| 4,681,337 | A * | 7/1987 | Bolton | 280/615 |
| 5,394,627 | A * | 3/1995 | Eugler | 36/117.3 |
| 6,901,686 | B2 * | 6/2005 | Hayes | 36/27 |

FOREIGN PATENT DOCUMENTS

| | | |
|---|---|---|
| CH | 157065 | 11/1932 |
| DE | 7220989 | 6/1972 |
| DE | 2826936 | 1/1980 |
| DE | 20015668 | 1/2001 |
| NO | 924886 | 6/1993 |

* cited by examiner

*Primary Examiner* — Katy M Ebner
(74) *Attorney, Agent, or Firm* — James Creighton Wray

(57) ABSTRACT

A ski binding device, in which a ski boot (4) is connected at its toe portion (6) to a ski (2), and in which there is arranged between the ski (2) and the ski boot (4) a guide (1) which is arranged to transfer torque (16) between the ski (2) and the ski boot (4) about the longitudinal axis of the ski (2).

16 Claims, 7 Drawing Sheets

Ia-Ia

Ib-Ib

VII-VII

SKI BINDING DEVICE

This application claims the benefit of Norwegian Application No. 20041023 filed Mar. 9, 2004 and PCT/NO2005/000079 filed Mar. 4, 2005, which are hereby incorporated by reference in their entirety.

BACKGROUND OF THE INVENTION

This invention relates to a ski binding. More particularly, it concerns a guide arranged between a ski and a ski boot, which is arranged to transfer, during the relative rotation of the ski and the ski boot, torques about the longitudinal axis of the ski between the ski and the ski boot. The guide is most advantageously arranged at the heel portion of the ski boot.

A conventional ski binding for touring or cross-country purposes includes a toe binding, in which the ski boot is clamped in a known manner. This clamping can be effected by means of, for example, a loop about the heel of the ski boot (for example, Kandahar) or by means of a locking device at the toe binding (for example, Rottefella).

Ski bindings of this kind connect the ski boot to the ski in a less stable manner, as the main portions of the ski boot can be rotated in a relatively great angular deflection about the longitudinal axis of the ski.

In order to connect the ski boot to the ski in a more stable manner, ski bindings have been developed, which lock the ski boot to the ski, as is usual to use when practicing slalom, for example. Prior art slalom bindings are designed in such a way that the ski boot is releasably attached to the ski at both the toe and heel portions of the ski boot.

During the practicing of different skiing techniques, exemplified here by so-called telemark skiing, it is of great importance for torques about the longitudinal axis of the ski to be transferred in a relatively stable manner between the boot and the ski, while at the same time the ski boot is free to rotate about its toe portion relative to the ski.

Known ski bindings either have insufficient rigidity relative to the transfer of torques about the longitudinal axis of the ski, or they lack the possibility of rotating the ski boot about the toe portion of the ski boot relative to the ski.

The invention has as its object to remedy or reduce at least one of the drawbacks of the prior art.

SUMMARY OF THE INVENTION

The object is realized in accordance with the invention through the features specified in the description below and in the following Claims.

According to the invention a ski binding, in which a ski boot is connected at its toe portion to a ski, is characterized in that between the ski and the ski boot there is arranged a guide, which is arranged to transfer torques about the longitudinal axis of the ski between the ski and the ski boot.

It is advantageous that the guide is active at least during part of the relative rotation of the ski boot about its toe portion relative to the ski.

The guide includes a first guide portion and a second guide portion cooperating with the first guide portion, either one being connected to one of the ski or the ski boot.

In a preferred embodiment the first guide portion is formed by a relative to the ski upright, preferably straight guide section, whereas the second guide portion is formed by a claw section, movably gripping the guide section with relatively little clearance. The guide section is most practically arranged on the ski, whereas the claw section is connected to the ski boot.

It has turned out to be favourable to provide the guide with a brake. Thus, between the first guide portion and the second guide portion there may be arranged a brake, which is arranged to brake a movement between the guide portions.

In some conditions vibration may occur between the ski and the binding. To overcome this phenomenon it is possible to arrange between the first guide portion and the second guide portion a damper that is arranged to cushion movement between the guide portions.

The guide according to the invention may be used with advantage together with prior art release bindings.

In what follows is described a non-limiting example of a preferred embodiment which is visualized in the accompanying drawings, in which:

DETAILED DESCRIPTION OF THE PREFERRED EMBODIMENTS

Figure 1:
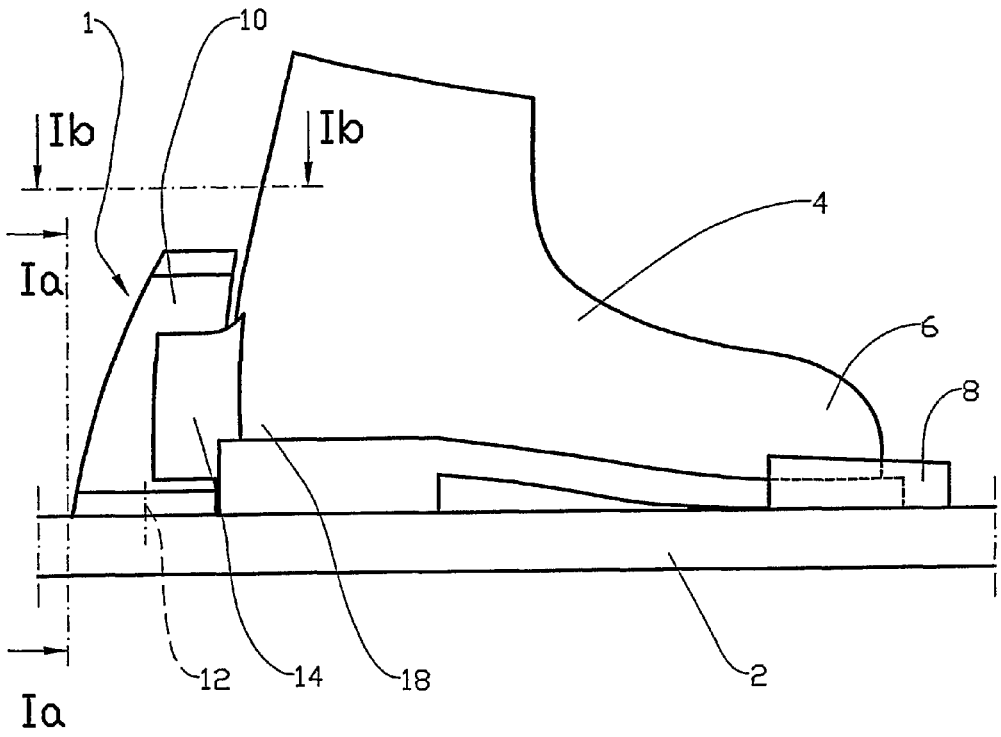
FIG. 1 shows a ski boot which is mounted on a ski by means of a toe binding, and which is guided at the rear portion of the ski boot by a guide.

In the drawings the reference numeral 1 denotes a guide, which is arranged between a ski 2 and a ski boot 4. At its toe portion 6, the ski boot 4 is connected to the ski 2 by means of a binding 8 of a design known per se.

In this preferred embodiment the first guide portion of the guide 1 is formed by an essentially upright plate-like guide section 10 connected to the ski by means of a securing element 12.

Figure 3:
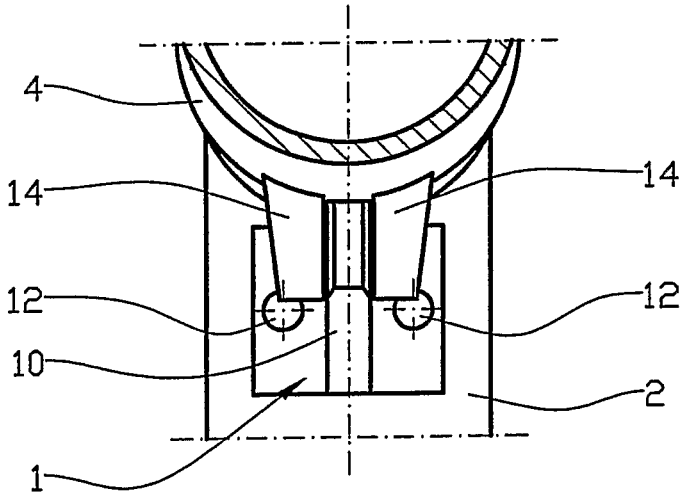
FIG. 3 shows a section Ib-Ib of FIG. 1.

The second guide portion of the guide 1 is formed by a claw section 14 fixed to the ski boot 4. The claw section 14 movably grips the guide section 10, see FIG. 3.

Figure 2:
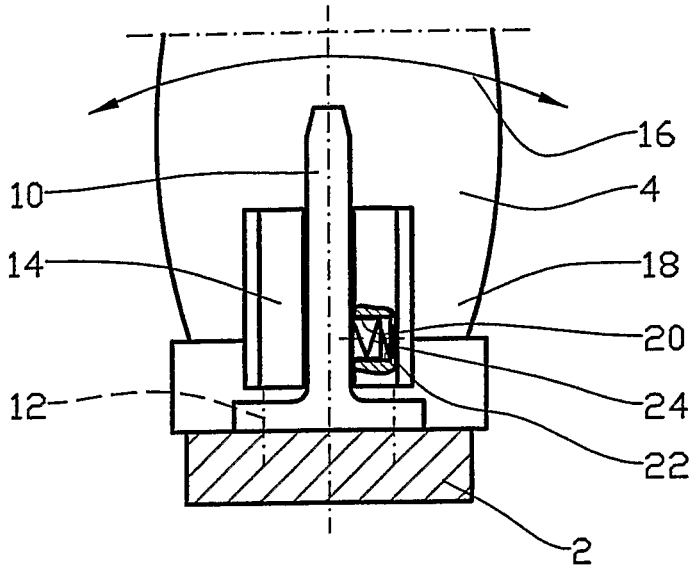
FIG. 2 shows a section Ia-Ia of FIG. 1.

A torque in the ski boot 4 about the longitudinal axis of the ski 2, indicated by the arrow 16 in FIG. 2, is transferred because of the length of the claw section 14 along the guide section 10, via the guide section 10 to the ski 2.

Figure 4:
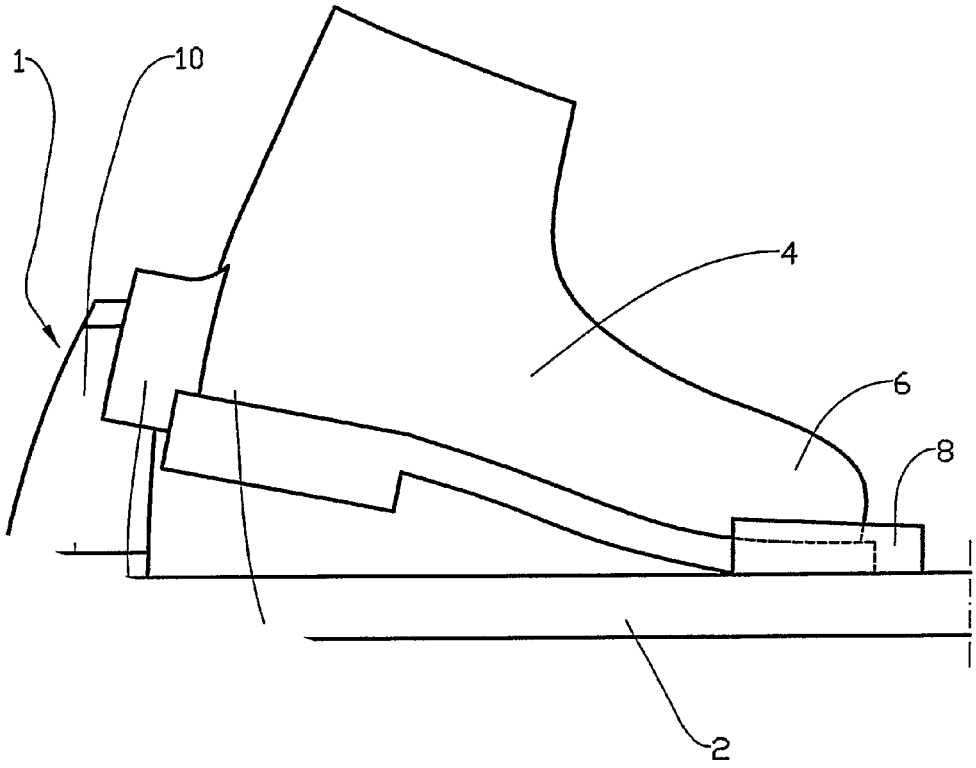
FIG. 4 shows the same as FIG. 1, but here the ski boot has been rotated somewhat about its toe portion, so that the heel of the ski boot has been lifted somewhat from the ski.
Figure 5:
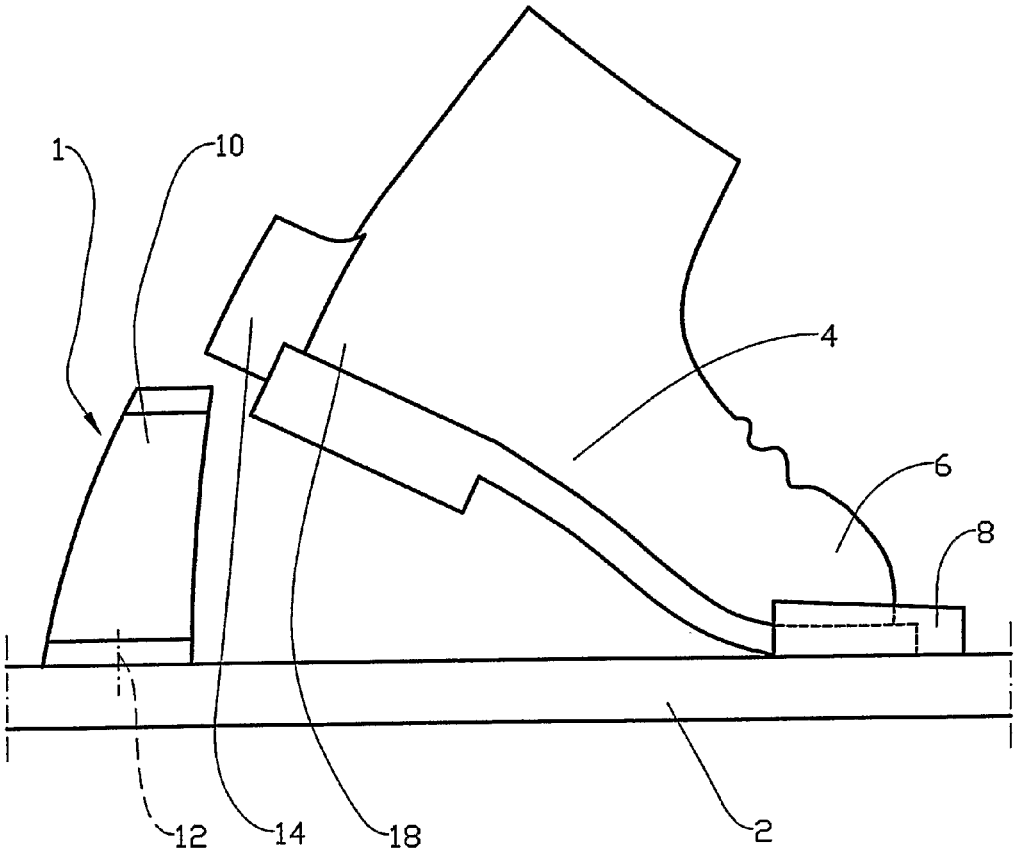
FIG. 5 shows the same as FIG. 4, but here the ski boot has been rotated further about its toe portion.

When the ski boot 4 is rotated about its toe portion 6 and thereby is lifted somewhat from the ski 2 at its heel portion 18, the claw section 14 is moved along the guide section 10, see FIG. 4. Said torque transfer is active until the ski boot 4 is rotated so much about its toe portion 6 that the claw section 14 loses its engagement with the guide section 10, see FIG. 5.

With advantage, the guide 1 may be provided with a brake pad 20, see FIG. 2, which is arranged to brake a movement between the guide section 10 and the claw section 14.

In a section in FIG. 2 the brake pad 20 is shown in a bore 22 in the claw section 14. A compression spring 24 is pre-tensioned between the claw section 14 and the brake pad 20 in the direction towards the guide section 10.

Figure 6:
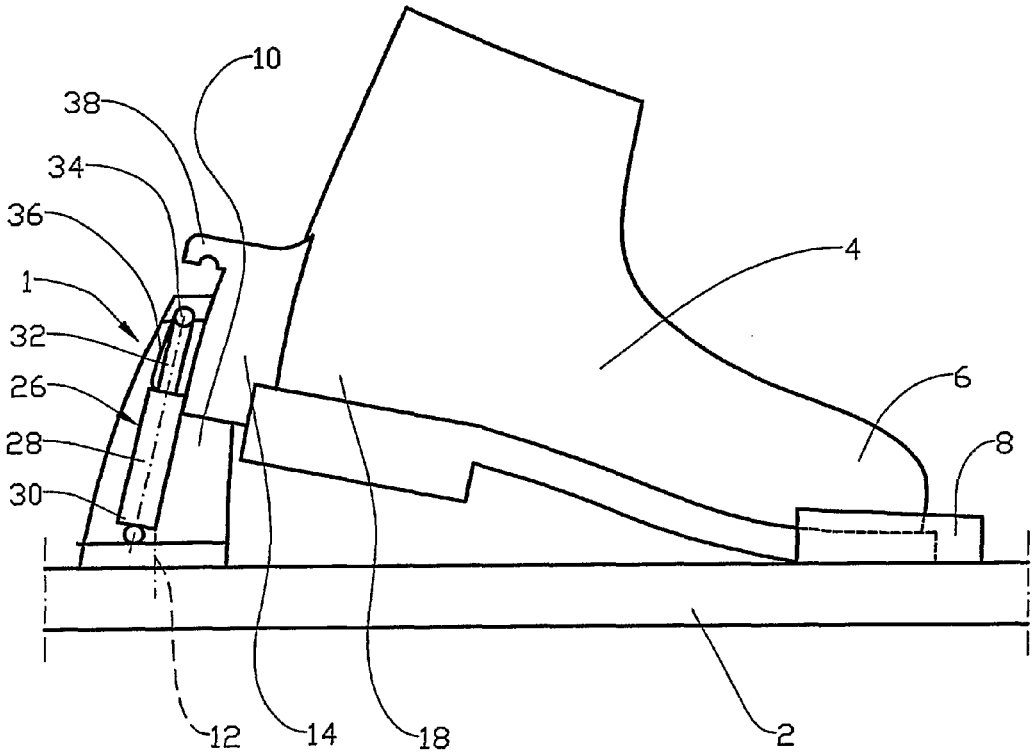
FIG. 6 shows a guide, which is provided with a damper, the ski boot being disengaged from the damper.
Figure 7:
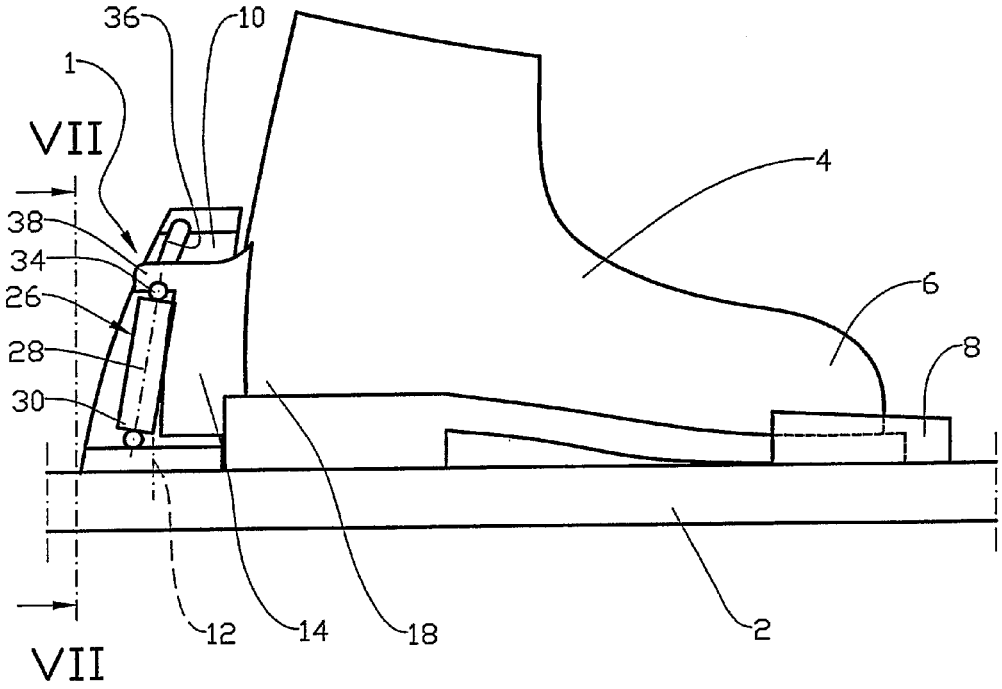
FIG. 7 shows the same as FIG. 6, but here the ski boot is in its position bearing on the ski, in which the damper is compressed.
Figure 8:
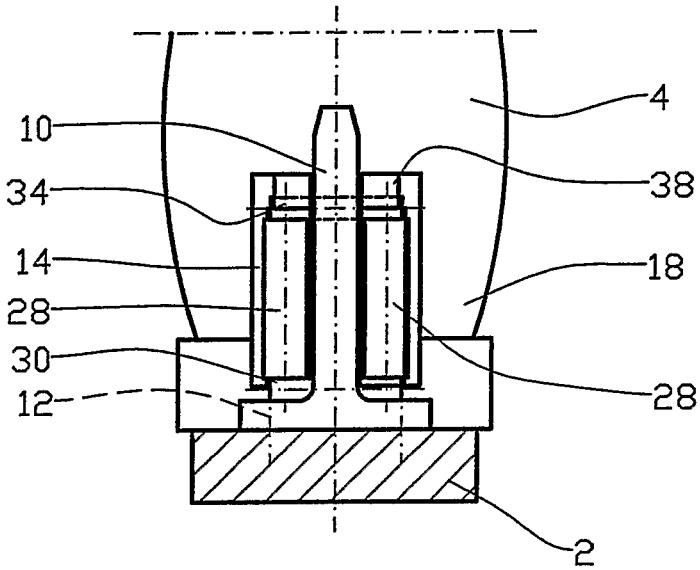
FIG. 8 shows a section VII-VII of FIG. 7.

In an alternative embodiment the guide 1 is provided with a damper 26, see FIGS. 6, 7 and 8. The damper 26 is arranged in such a way that it is active only when the heel portion 18 of the ski boot 4 is close to the ski 2.

In this embodiment the damper 26 is a two-part damper, there being one damper section 28 on either side of the guide section 10. The damper section 28 articulate at their lower portions 30 on the guide section 10. At their upper movable portions 32, see FIG. 6, the damper sections 28 are connected by means of an axle 34 extending through an essentially vertically elongate groove 36 in the guide section 10.

The claw section 14 includes a damper stopper 38, which is arranged to bear on the axle 34 when the ski boot 4 is moved down towards the damper 26. In the further movement of the ski boot 4 down towards the ski 2, the damper sections 28 are compressed, see FIGS. 6 and 7.

The invention claimed is:

1. A ski binding device, in which a ski boot (4) is connected to a ski (2) at its toe portion (6) comprising a guide (1) having a first guide portion extending upwardly from the ski (2) and a second guide portion having a height greater than a width to co-operate with the first guide portion, wherein the second guide portion is attached to the ski boot (4) on a rearward facing surface of the boot at its heel portion (18), wherein mutual guiding surfaces of the first guide portion and the second guide portion are adjacently arranged so as to transfer torque (16) around a longitudinal axis of a sole of the ski boot (4) to the ski (2) as torque around the longitudinal axis of the ski (2) when the ski boot is rotated about its own longitudinal axis whereby the boot and the ski rotate together about their longitudinal axes and also rotate together when the heel portion (18) is at a distance from the ski.

2. A device in accordance with claim 1, wherein one of the first and second guide portions (1) is formed by a vertical guide plate section (10) extending in a longitudinal direction of the ski and vertically upwards relative to the ski, and that the other of the first and second portions (1) is formed by a vertically elongated claw section (14) arranged to slide up and down on the vertical guide plate and to movably grip the guide plate section (10).

3. A device in accordance with claim 2, wherein the guide plate section (10) is arranged on the ski (2) and the vertically elongated claw section (14) is connected to the ski boot (4).

4. A device in accordance with claim 2, wherein the vertical guide plate section (10) is arranged on the ski boot (4) and the vertically elongated claw section (14) is connected to the ski (2).

5. A device in accordance with claim 1, wherein between the first guide portion of the guide (1) and the second guide portion of the guide (1) a brake (20) is provided, and wherein the brake has a brake pad and a pretensioned compression spring and is arranged to brake movement between the guide portions.

6. A device in accordance with claim 3, wherein between the first guide portion of the guide (1) and the second guide portion of the guide (1) dampers (26) are provided on opposite sides of the guide plate section, which is arranged to dampen movement between the guide portions.

7. A device in accordance with claim 6, wherein a movable shaft (34) connecting upper ends of the dampers (26) extends in a slot (36) in the guide plate section.

8. A device according to claim 1, wherein the first guide portion is a vertical plate, and the vertical plate first guide portion is aligned with the longitudinal axis of the ski, and wherein the second guide portion is a vertical claw section and wherein the vertical claw section is attached to the heel of the boot to movably grip the vertical plate first guide portion when the heel of the boot is lifted from the ski.

9. A ski binding device, in which a ski boot is connected to a ski at its toe portion comprising a guide having a first vertically oriented guide portion extending upwardly from the ski and a second unitary vertically oriented claw guide portion, having a height greater than a width to co-operate with the first guide portion, wherein the second guide portion is attached to the ski boot on a rearward facing surface of the boot at its heel portion, wherein mutual guiding surfaces of the first and second guide portions are adjacently arranged so as to transfer torque around a longitudinal axis of the ski boot to the ski as torque around the longitudinal axis of the ski, such that the ski boot and the ski rotate together when the ski boot is rotated about its own longitudinal axis and the heel portion is at a distance from the ski, and wherein the first vertically oriented guide portion of the guide is formed by a vertical plate guide section, and that the vertically oriented second guide portion of the guide is formed by a vertical claw section arranged to movably grip the guide section.

10. A device in accordance with claim 9, wherein the guide is active during part of the vertical elevation of the ski boot heel relative to the ski and the boot toe portion until the vertical claw section rises above the vertical plate guide section.

11. A device in accordance with claim 9, wherein the torque is transferred because of the vertical length of the claw section.

12. A device in accordance with claim 9, wherein between the first guide portion of the guide and the second guide portion of the guide a brake is provided, which is arranged to brake movement between the guide portions.

13. A device in accordance with claim 10, wherein between the first guide portion of the guide and the second guide portion of the guide parallel dampers are provided, which are arranged to dampen movement between the guide portions.

14. A device in accordance with claim 13, wherein a movable shaft connected to the dampers extends in a slot in the first guide portion.

15. A ski binding device, in which a ski boot is connected to a ski at its toe portion, comprising a guide having a first vertically oriented guide portion extending upwardly from the ski and a second vertically oriented claw guide portion having a height greater than a width to co-operate with the first guide portion wherein the second guide portion is attached to the ski boot on a rearward facing surface of the boot at its heel portion, wherein mutual guiding surfaces of the first and second guide portions are adjacently arranged so as to transfer torque around a longitudinal axis of the ski boot to the ski as torque around the longitudinal axis of the ski, such that the ski boot and the ski rotate together when the ski boot is rotated about its own longitudinal axis and the heel portion is at a distance from the ski, wherein the first guide portion is a plate, and the first guide portion is aligned with the longitudinal axis of the ski, and wherein the second guide portion is the claw section and wherein the claw section is attached to the heel of the boot to movably grip the first guide portion when the heel of the boot is lifted from the ski.

16. A method for transferring torque (16) between a heel portion (18) of a ski boot (4) and a ski (2) during Telemark skiing even when the heel portion (18) is lifted from the ski (2), wherein the ski boot (4) at its toe portion (6) is connected to the ski (2), wherein the method further comprises:

providing a guide (1) having a first guide portion that extends upwardly from the ski (2) and a second guide portion having a height greater than a width to co-operate with the first guide portion, wherein the second guide portion is attached to the ski boot (4) on a rearward facing surface of the boot at its heel portion (18);

arranging mutual guiding surfaces of the first guiding portion and the second guiding portion for transferring torque (16) around a longitudinal axis of a sole of the ski boot (4) to the ski as torque around the longitudinal axis of the ski (2) when the ski boot is rotated about its own longitudinal axis whereby the boot and the ski rotate together about their longitudinal axes and also rotate together when the heel portion (18) of the ski boot is at a distance from the ski.

* * * * *